United States Patent [19]

Zuk

[11] 4,404,234

[45] Sep. 13, 1983

[54] ELECTRODE COATING PROCESS

[75] Inventor: Paul Zuk, Allentown, Pa.

[73] Assignee: Bell Telephone Laboratories, Incorporated, Murray Hill, N.J.

[21] Appl. No.: 333,976

[22] Filed: Dec. 23, 1981

[51] Int. Cl.[3] ..... B05D 5/12

[52] U.S. Cl. ..... 427/37; 427/58; 427/122; 427/331; 361/120

[58] Field of Search ..... 427/37, 58, 122, 331, 427/444; 29/25.14; 361/120

[56] References Cited

U.S. PATENT DOCUMENTS

| | | | |
|---|---|---|---|
| 2,525,263 | 10/1950 | Macksond | 427/37 |
| 2,887,413 | 5/1959 | Ekkers et al. | 427/37 |
| 3,454,811 | 7/1969 | Scudner, Jr. | 313/220 |
| 3,720,499 | 3/1973 | Hirayama et al. | 427/37 |
| 3,898,533 | 8/1975 | Scudner, Jr. | 317/61 |
| 3,958,154 | 5/1976 | Hill et al. | 361/120 |
| 4,037,266 | 7/1977 | English et al. | 361/120 |
| 4,175,277 | 11/1979 | Zuk | 361/120 |

FOREIGN PATENT DOCUMENTS

| | | | |
|---|---|---|---|
| 828336 | 2/1960 | United Kingdom | 427/37 |

OTHER PUBLICATIONS

Sealey, R., "How to Keep Your Volkswagen Alive" John Muir Publications, Santa Fe, New Mexico, ©1980, p. 113.

*Primary Examiner*—Michael R. Lusignan
*Assistant Examiner*—Richard Bueker
*Attorney, Agent, or Firm*—Lester H. Birnbaum

[57] ABSTRACT

Disclosed is a method of coating electrodes in spark gap devices which minimizes filament formation. A coating (21) such as carbon is deposited on the electrode surfaces (11 and 12). A signal is then applied so that the device conducts in the arc mode for several short periods. A small spot of the coating bonds with the negatively biased electrode during each conduction. This operation continues at alternating polarities until essentially the entire surface area of both electrodes is bonded.

9 Claims, 4 Drawing Figures

ELECTRODE COATING PROCESS

BACKGROUND OF THE INVENTION

This invention relates to coating electrode surfaces, and in particular to a coating method which minimizes filament formation in surge limiters.

Surge limiters have for many years been used to protect apparatus from high voltage surges resulting from various causes, such as lightning strikes. The devices basically comprise a pair of electrodes with a spark gap therebetween. The device, which is coupled in parallel with the protected apparatus, is nonconducting during normal operation of the apparatus. However, when a voltage surge of sufficient magnitude appears at the electrodes, a spark is produced across the gap and the surge is shunted from the protected apparatus. In the sealed gas surge limiter, the electrodes are placed in a hermetically sealed housing along with an inert gas. The device fires when the gas in the gap area is sufficiently ionized to produce a spark.

It has been recognized in such devices that a coating of graphite on the surface of the electrodes will improve device performance by increasing electron emission from the electrode and thereby enhancing formation of the plasma discharge in the gap. One problem associated with such coatings, however, is the formation of carbon filaments on the surface after a few discharges of the device, which results in leakage currents and could produce short circuits in extreme cases.

It is, therefore, a primary object of the invention to provide a coating on the surface of the electrodes with sufficient bonding therebetween so that filament formation is minimized.

SUMMARY OF THE INVENTION

This and other objects of the invention are achieved in accordance with the invention which is a method for fabricating a device having two electrodes and a spark gap defined therebetween, and the resulting product. A coating is first deposited on the surface of the electrodes. A signal is then applied to the electrodes to cause conduction in the arc mode for several short periods of time so that for each of said periods a different portion of the coating bonds with the electrodes.

BRIEF DESCRIPTION OF THE DRAWINGS

These and other features of the invention will be delineated in detail in the following description. In the drawings.

It will be understood that for purposes of illustration these FIGURES are not necessarily drawn to scale.

DETAILED DESCRIPTION OF THE INVENTION

Figure 1:
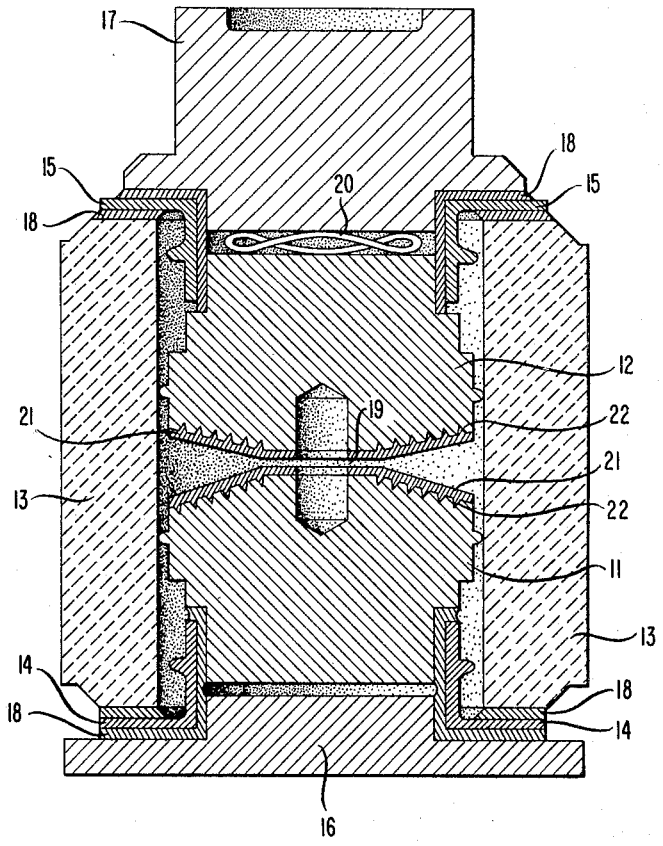
FIG. 1 is a cross-sectional view of a typical sealed gas surge limiter fabricated in accordance with one embodiment of the invention.

FIG. 1 illustrates a sealed gas surge limiter which makes use of the principles of the invention in accordance with one embodiment. The device includes two electrodes, 11 and 12, defining a narrow spark gap 19 therebetween. The electrodes were bonded to flanges, 14 and 15, which were, in turn, bonded to opposite ends of an insulating housing, 13. Also bonded to the flanges and electrically coupled to the electrodes were terminals, 16 and 17. The housing was filled with argon gas and hermetically sealed utilizing a fusible metal 18 for all bonding between electrodes, flanges, terminals and the insulating housing. A spring, 20, was included between electrode 12 and terminal 17 to aid in achieving a uniform gap.

In this particular device, a narrow gap of approximately 67 μm was formed between the flat portions of the electrode surfaces. Preferably, this minimum gap distance is less than 75 μm. Such a narrow gap results in a device which will fail in a closed circuit condition if a leak develops, and failures can therefore be detected and faulty devices replaced without danger to the protected apparatus. (For more details on the structure of such devices, see U.S. Pat. No. 4,175,277 issued to Zuk.) The sloped portions of the electrodes typically extend to 200 μm apart.

In this example, the electrodes were made of copper and included a coating, 21, of carbon (graphite) on the portion of the electrode surfaces which face each other. The coating was fabricated in accordance with the method of the invention described below. The electrode surfaces also included grooves, 22, to inhibit deterioration of the carbon coating. (See, for example, U.S. Pat. No. 4,037,266 issued to English et al.) The insulating housing was made of ceramic, the flanges were made of copper, and the terminals comprised an iron-nickel alloy plated with nickel. The fusible metal was a silver-copper eutectic.

In accordance with one embodiment of the invention, the carbon coating, 21, was formed on the electrode surface by first depositing the coating by a standard spraying of colloidal graphite (a suspension of graphite in alcohol and water). In this example, the coating was approximately 3μ thick but will generally fall within the range 1.5–5 μm. The device was then completely assembled according to standard fabrication techniques.

Figure 2:
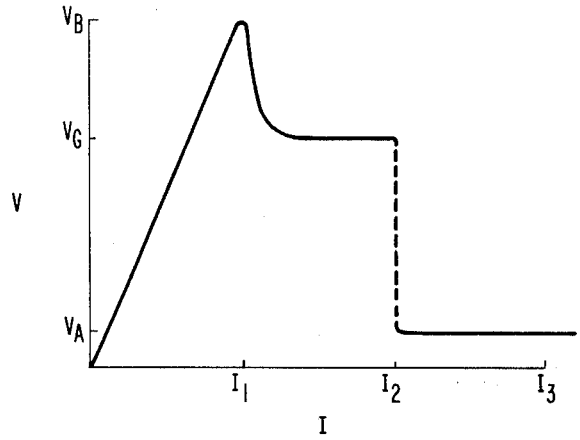
FIG. 2 is a current-voltage characteristic of the device in FIG. 1 illustrating arc mode conduction.

Following assembly, the device was then subject to a signal which caused the device to conduct in the arc mode for several short periods of time. Arc mode conduction may be understood by referring to FIG. 2 which shows a voltage-current curve for a typical device when a slowly rising voltage is applied to the electrodes, i.e., a slope of approximately 2000 v./sec. At some point, the device will reach the breakdown voltage $V_B$ after which the device conducts in the "glow mode" from $I_1$ to $I_2$ at a fairly constant voltage below breakdown. As current increases beyond $I_2$ in the interval $I_2$–$I_3$, the device will operate in the arc mode where the voltage across the electrodes will be at a fairly constant, but much lower, value. In this example, the breakdown voltage, $V_B$, was 300 v, the glow mode voltage $V_G$ was approximately 180 v, and the arc mode voltage, $V_A$, was approximately 15 v. The lower current ($I_1$) for the glow mode was of the order of microamps and the interval for the arc mode was above 200 milliamps.

It was discovered that each time the device was operated in the arc mode, the temperature reached was sufficient to cause a reaction between the coating on the cathode and the underlying electrode to form a stronger bond. The mechanism was therefore distinctly different from standard prior art aging processes which drove the limiter primarily in the glow mode and caused sputtering of particles from the electrode surface. (See, for example, U.S. Pat. No. 3,454,811 issued to Scudner.) (It will be noted that some sputtering will occur during the method according to the present invention, but this is not the primary reaction.) It was also discovered that if discrete pulses of short duration were utilized (less than 200 μsec), the spark produced during each firing would occur at random to unreacted areas around the surface of the electrode to essentially cause a different portion of the coating to react during each firing. Further, by reversing polarity of the pulses, the other electrode in the limiter could be so treated. Thus, if a signal comprising many short pulses of sufficient magnitude to cause the device to conduct in the arc mode was applied to the device and the polarity of the signal reversed at certain intervals, essentially the entire carbon coating on the surface of both electrodes 11 and 12 could form a strong bond with the electrodes.

Figure 3:
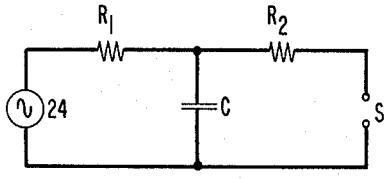
FIG. 3 is a circuit diagram of a circuit which is useful in applying a signal to the device during one fabrication step in accordance with the same embodiment.
Figure 4:
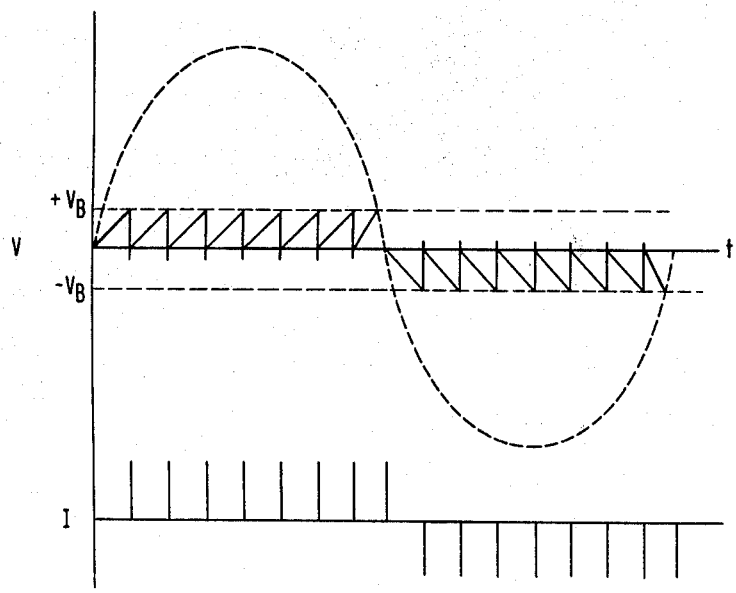
FIG. 4 is an illustration of the voltage across the electrodes and current through the electrodes during the application of the signal from the circuit in FIG. 3.

Such a signal was supplied, for example, by the circuit illustrated in FIG. 3. Current was supplied by an AC signal source, 24, which produced a 60 cycle/-second signal with voltage of 1000 volts RMS. The source was coupled to the surge limiter socket S, through resistors $R_1$ and $R_2$ coupled in series with the limiter. Coupled between the two resistors and in a discharge path in series with one of the resistors ($R_2$) and the socket was a capacitor, C. The circuit was designed to operate in the relaxation oscillator mode with sufficient current supplied to the limiter so that each time the device conducts it will switch to the arc mode, and with sufficiently short pulses to ensure reaction of a different portion with each pulse. Thus, C stores charge until the voltage across the limiter reaches breakdown, at which time C discharges through $R_2$ to the limiter with sufficient current to cause arc mode conduction for a short period. The current is a pulse determined by C, $R_2$, and the inductance of $R_2$. After this period, conduction stops and the voltage across the limiter begins increasing until breakdown is again achieved and the process repeats. This operation of the limiter is illustrated in FIG. 4 which is an approximate representation of the voltage across the device and the current therethrough for one cycle of the AC signal. It will be noted that the device fired several times during each half-cycle. (In the FIGURE, only eight firings are shown during each half-cycle for the purpose of illustration.) In this example, the device actually fired approximately 17 times during each half-cycle. During each firing, arc mode conduction was achieved with a peak current of approximately 1.4 amps resulting in surface temperatures of several thousand degrees. This was sufficient to cause a reaction between the copper and carbon at a different, small area of the negatively biased electrode during each firing. During the second half of the cycle, when the polarity was reversed, the reactions occurred on the other electrode. This procedure was repeated for several cycles (approximately 20 seconds in this example) until the entire carbon coating on both electrode surfaces had thus reacted.

In such a process, it is recommended that the time of each conduction in the arc mode be within the range 1 μsec–200 μsec, but times up to 400 μsec are feasible. If the period is too short, the spot size is too small making it difficult to produce a complete reaction of the electrode surface, and if it is too long the electrode may be damaged. The actual time period for each arc mode conduction in this example was approximately 20 μsec for the main pulses (and less for random parasitics). It should be realized that these conductions may be obtained by isolated pulses having the proper width as described here, or by a rapid sequence of current spikes which individually have very short widths but the effect of which is apparently to keep the gas ionized for the duration of the sequence of current spikes. (See Patent application of Haas, Herring, and Nakada, filed on an even date herewith and assigned to the same assignee, which is incorporated by reference herein.)

To ensure that a different area will be reacted during each current pulse, it is recommended that each current pulse be terminated with a voltage polarity reversal of a few volts, as shown in FIG. 4, to assure turn-off of the device. For the same purpose, it is recommended that the current pulses be at least a millisecond apart. A peak current of at least 1 amp is recommended to insure arc mode conduction for all devices.

In the circuit shown in FIG. 3, all these conditions were met by employing commercial wire-wound (inductive) resistances consisting of six resistors of 1470 ohms each coupled in series for $R_1$, a commercial wire-wound resistor of 215 ohms for $R_2$, and a capacitor having a capacitance of 0.1 μf. The inherent inductances of the wire-wound resistors provide the slight voltage polarity reversal for turn-off at the end of each pulse. The capacitance will determine the amount of energy delivered to the limiter when breakdown is achieved, and the value of $R_2$ will control the size of the area reacted in each arc mode conduction by controlling the peak current of the pulse. $R_1$ will determine the time necessary for charging the capacitor and therefore controls the pulse repetition rate. Of course, the values of the resistors, capacitors and current source can be adjusted according to particular needs. In fact, the circuit shown in FIG. 3 is merely illustrative of the type of circuit which may be used in carrying out the invention. Any circuit which causes the device to operate in accordance with the method of the invention may be utilized.

In actual commercial practice, additional circuit parasitics should be considered to ensure a uniform surface reaction and to speed the aging process. A recommended means of achieving these ends in a commercial environment is described and claimed in U.S. patent application of Haas, Herring, and Nakada, cited previously.

The point at which the method may be terminated can be determined by a visual inspection of the electrode surfaces, since the reacted area will appear covered with contiguous spots. Alternatively, the time can be determined for each type of device empirically by looking at the distribution of breakdown voltages and surge limiting voltages for groups of devices aged at various times. If the time is too short, there will be a wide variation in these values, and if it is too long, the median surge limiting voltage will increase.

Several devices were fabricated in accordance with the above-described embodiment of the invention. When the appropriate signal was applied, for example, to a group of 12 devices for 20 seconds, the breakdown voltage did not vary more than 20 volts, and the surge limiting voltage did not vary more than 300 volts, with a median value for the latter of 400 volts. This distribution indicated the devices were essentially free of filaments.

Although the invention has been described utilizing a graphite coating on the electrodes, it may also be applicable with use of other coatings, for example, molybdenum, tungsten, copper, and emissive glass coatings. Further, the underlying electrode need not be copper, but can be molybdenum, tungsten, and other conductors.

Also, although it is advantageous to react the coating and electrodes after the device is completely assembled, such a process can be performed prior to assembly if desired.

Various additional modifications will become apparent to those skilled in the art. All such variations which basically rely on the teachings through which the invention has advanced the art are properly considered within the spirit and scope of the invention.

What is claimed is:

1. A method of fabricating a sealed gas surge limiter having two electrodes (11 and 12) and a spark gap (19) therebetween comprising the steps of depositing a coating (21) on a portion of the electrodes and thereafter applying a pulsed signal of controlled amplitude and pulse duration of the electrodes which causes conduction in the arc mode for several periods of time of less than 400 μsec so that for each of said periods a limited portion of the coating bonds with one of the electrodes.

2. The method according to claim 1 wherein the coating comprises carbon.

3. The method according to claim 1 wherein the electrodes comprise copper.

4. The method according to claim 1 wherein the signal is applied by a circuit including an AC current source (24), a plurality of resistors ($R_1$,$R_2$) coupled in series with the source and the electrodes, and a capacitor (C) coupled in a discharge path in series with the electrodes and at least one of said resistors.

5. The method according to claim 1 wherein the periods of arc mode conduction are within the range 1 μsec–200 μsec.

6. The method according to claim 1 wherein the minimum spark gap is less than 75 μm.

7. The method according to claim 1 wherein the signal is applied to the electrodes by a circuit including an AC current source so that arc mode conduction is produced several times throughout each half-cycle of the current.

8. A method of fabricating a sealed gas surge limiter having two electrodes (11 and 12) and a narrow spark gap (19) therebetween comprising the steps of depositing a carbon coating (21) on a portion of the electrodes and thereafter applying to the electrodes by means of a circuit including an AC current source a signal comprising pulses of sufficient amplitude and short duration to cause conduction of the device in the arc mode for several periods of time less than 400 μsec throughout each half-cycle of the current source so that for each of said periods a different limited portion of the carbon coating bonds with the negatively biased electrode, the signal being applied until the surfaces of the electrodes are essentially free from filaments.

9. The method according to claim 1 or 8 wherein each current pulse is terminated with a voltage polarity reversal to assure turn-off of the device.

* * * * *

UNITED STATES PATENT AND TRADEMARK OFFICE

CERTIFICATE OF CORRECTION

PATENT NO. : 4,404,234

DATED : September 13, 1983

INVENTOR(S) : Paul Zuk

It is certified that error appears in the above—identified patent and that said Letters Patent is hereby corrected as shown below:

Column 5, line 23, "of" should read --to--.

Signed and Sealed this

*Seventeenth* Day of *July 1984*

[SEAL]

*Attest:*

GERALD J. MOSSINGHOFF

*Attesting Officer*

*Commissioner of Patents and Trademarks*